United States Patent [19]

Catallo

[11] Patent Number: 5,046,208

[45] Date of Patent: Sep. 10, 1991

[54] METHOD AND APPARATUS FOR APPLYING ADDITIVES IN A BALLOONED FABRIC EXTRACTION SYSTEM

[76] Inventor: Frank Catallo, 84 Wheatley Rd., Old Westbury, N.Y. 11568

[21] Appl. No.: 498,439

[22] Filed: Mar. 26, 1990

[51] Int. Cl.[5] ..... D06B 3/18

[52] U.S. Cl. ..... 8/151; 68/22 R; 68/13 R; 68/183

[58] Field of Search ..... 68/22 R, 13 R, 183; 8/151

[56] References Cited

U.S. PATENT DOCUMENTS

| | | | |
|---|---|---|---|
| 1,893,197 | 1/1933 | Cohn | 8/151 |
| 3,548,616 | 12/1970 | Catallo et al. | 68/22 R |
| 4,112,532 | 9/1978 | Catallo | 8/151 |
| 4,182,140 | 1/1980 | Sando et al. | 68/183 |
| 4,213,217 | 7/1980 | Kretschmer et al. | 8/151 |
| 4,285,694 | 8/1981 | Itoh et al. | 8/151 |
| 4,484,369 | 11/1984 | Diggle, Jr. et al. | 8/151 |
| 4,799,367 | 1/1989 | Schuierer et al. | 68/13 R |
| 4,843,669 | 7/1989 | Koch et al. | 68/22 R |

FOREIGN PATENT DOCUMENTS

| | | | |
|---|---|---|---|
| 1054048 | 4/1959 | Fed. Rep. of Germany | 8/151 |
| 535296 | 2/1955 | France | 8/151 |

*Primary Examiner*—William A. Cuchlinski, Jr.
*Assistant Examiner*—G. Bradley Bennett
*Attorney, Agent, or Firm*—Leo Fornero

[57] ABSTRACT

This invention is directed to an extractor wherein tubular knitted fabric is ballooned, prior to the extraction of, usually water from the fabric, in an arrangement comprising a nip formed by two rolls. A tubular knit fabric additive applying mechanism is formed by providing a reservoir consisting of these two rolls and sealing or dam members disposed at each of the opposite ends of the above mentioned rolls. A single drive is provided one roll and functions to drive the second roll and a third roll disposed to form a nip with the second roll to extract excess additive from the fabric as it passes through the last mentioned nip. A method of applying an additive to a tubular knitted fabric moving the fabric through a nip to extract liquid therefrom and then immediately subjecting the fabric to an application of additive and immediately following this application by subjecting the fabric to the removal of the additive in a second nip.

10 Claims, 4 Drawing Sheets

METHOD AND APPARATUS FOR APPLYING ADDITIVES IN A BALLOONED FABRIC EXTRACTION SYSTEM

BACKGROUND OF THE INVENTION

The invention relates to an apparatus for applying an additive to tubular knitted fabrics. It is customary to apply these additives to such fabrics after they are bleached and dyed to facilitate the further treatment such as sewing or even to impart characteristics to the fabric such as a soft hand.

This application of additives usually takes place after certain procedures are applied to the tubular or circular knitted fabric. Some of these practices involve extraction of water and straightening and flattening the fabric to reduce as much as possible any wrinkles that have occurred in prior treatments.

Early techniques at removing excess moisture from circular knitted fabrics consisted of treating such fabrics in centrifugal extractors wherein the already tangled fabric suffered even greater wrinkles and deformities. This required drying and straightening by hand in order to prepare for further processing.

New technologies evolved for extracting excessive additives and adding such additives and many of these improvements are still being practiced presently. Some of these techniques are shown in U.S. Pat. Nos. 3,548,616, to Frank Catallo et al, 1,893,197 and 3,207,616.

More recent developments for extracting excessive moisture from circular type knitted fabrics consists of ballooning the fabric in a chamber and then passing the ballooned fabric to an extraction nip formed by two rolls adapted to receive the circular knitted fabric.

The fabric as it is wet is also filled with air which has a ballooning affect on same and better prepares the fabric for subsequent treatment.

As will be evident, fabric that is flat, smooth and devoid of wrinkles is desirable for further processing as treatment of same does not require the time consuming wrinkle removal operations. Also the even extraction of additives is facilitated.

However additive application to the ballooning type arrangement presently known by me are cumbersome, costly and inefficient. Some of the arrangements for additive application utilized involved spraying the fabric before extraction. Dipping the fabric is also a technique that has been practiced.

Some of the deficiencies found in such practices are chemical dilution of the additive, added tension of the fabric and the lack of uniform application of the solution.

It is therefore an object of the present invention to provide an additive applying arrangement in a balloon extraction system which is efficient, compact and economical to manufacture and free from the above mentioned deficiencies and others.

Another object of this invention is to utilize the normal extraction rolls of the ballooned fabric type extractor for circular knit fabrics with novel changes to serve as a new and improved additive application system and apparatus.

For a more complete understanding of the invention and other features and advantages thereof reference should be made to the following detailed description of a preferred embodiment and to the accompanying drawings.

BRIEF DESCRIPTION OF THE DRAWINGS

In the drawings wherein like reference numerals denote corresponding parts through the several views.

GENERAL DESCRIPTION OF THE INVENTION

Broadly in accordance with the present invention an additive applying arrangement is associated with a ballooned fabric extraction apparatus whereby the benefits of the balloon arrangement of providing smooth and wrinkle free fabric along with the benefit of efficient and inexpensive application of additives are achieved. Also geometrical realignment of the fabric is achieved.

Figure 1:
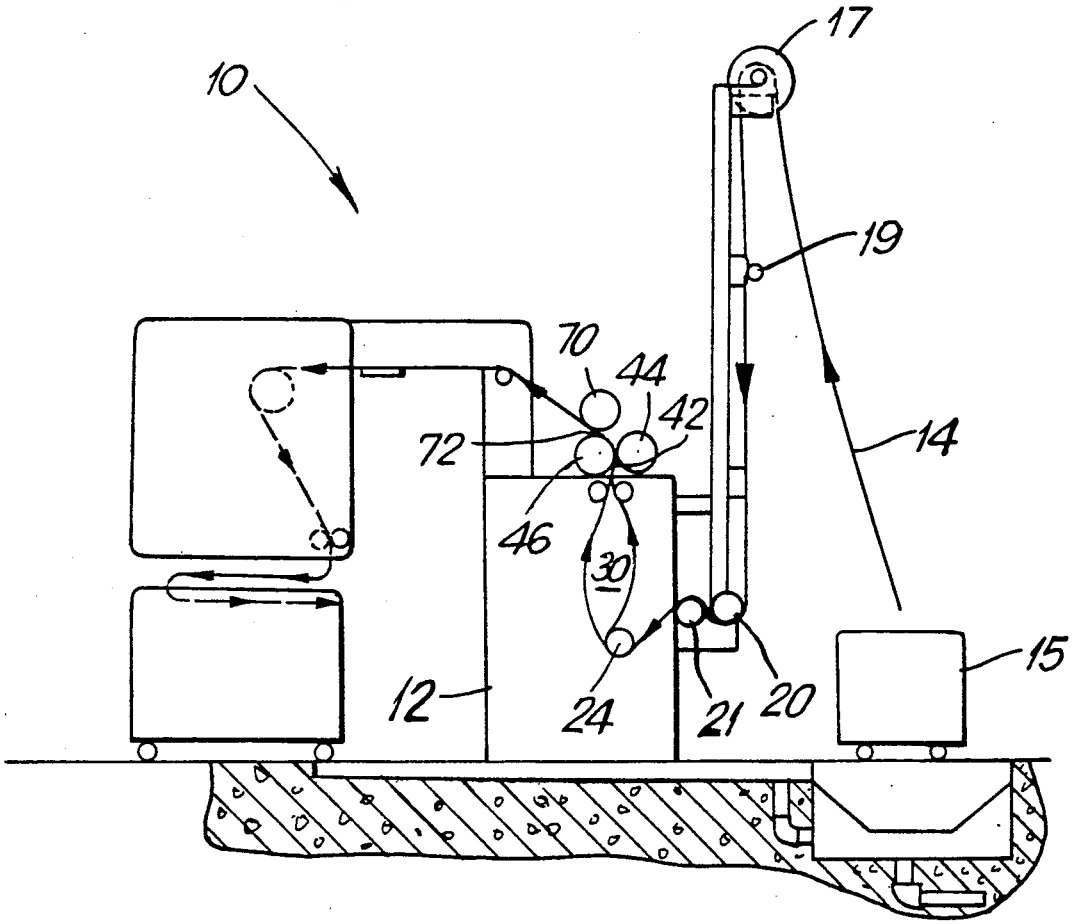
FIG. 1 is a diagrammatical partial cross sectional view showing a ballooned fabric extraction apparatus including the additive applying arrangement contemplated herein.

Such apparatus including the additive applying arrangement is shown diagrammatically in FIG. 1. The interior portion of the extraction chamber is shown partially in section in FIG. 2. The balloon extraction system, generally designated 10, as will be understood by one skilled in the art, comprises an extraction chamber 12, which functions to balloon circular knitted fabric 14 passing therethrough as follows:

The circular or tubular knitted fabric is usually brought to the ballooned fabric extraction apparatus via truck 15 from where it passes over a skyer roll 17 through a detwister 19 serving to straighten the fabric 14 which then passes around feed rolls 20 and 21 as shown in FIG. 1. The fabric 14 then passes around the roll 24 which serves to guide the fabric in an upwardly, preferably vertical, direction as is evident in FIG. 1 and FIG. 2.

Figure 2:
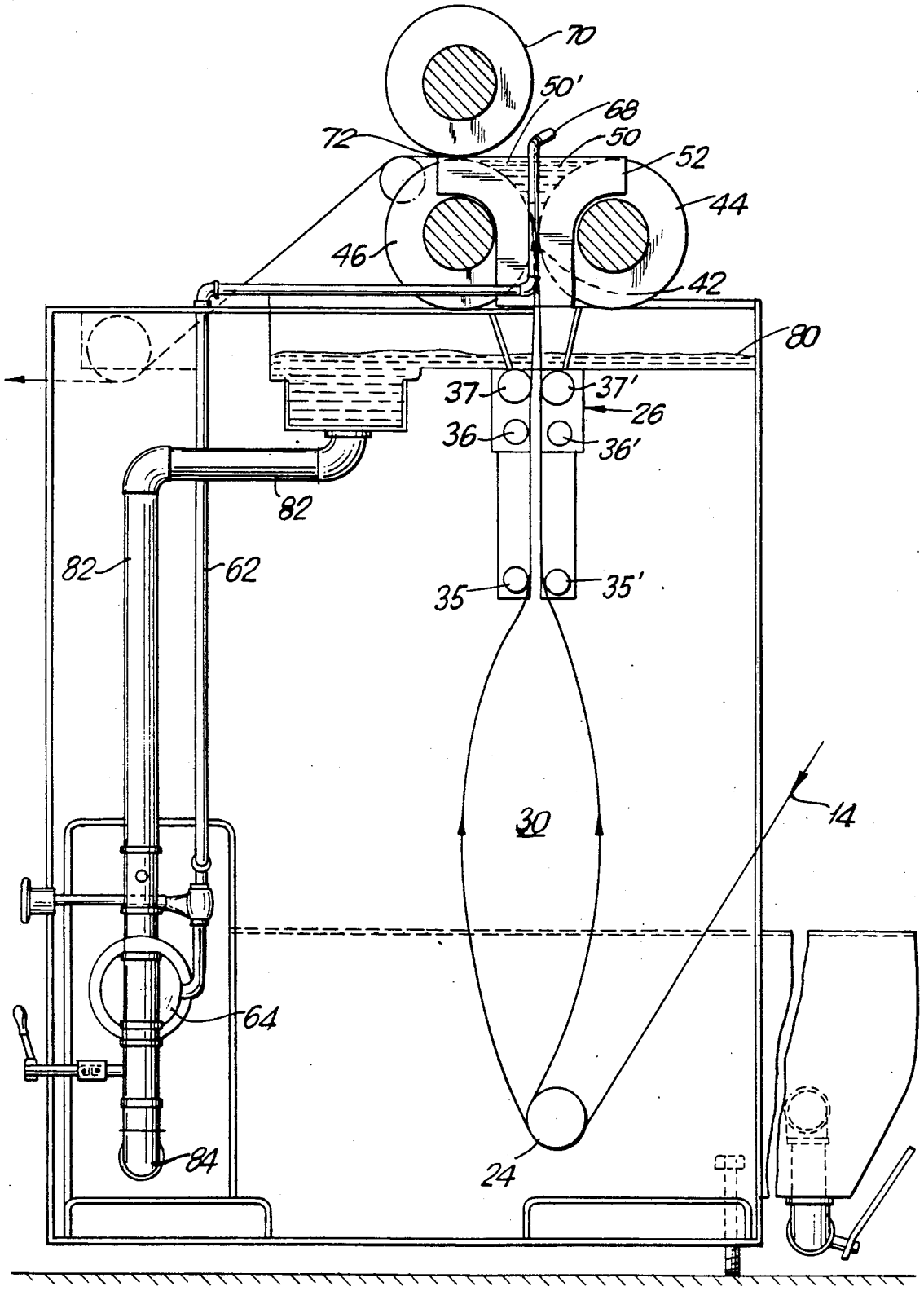
FIG. 2 is a side view partly in section of the interior of the extraction chamber of the balloon apparatus which incorporates the invention contemplated herein.

It is usual in such systems to provide the air and liquid to balloon the fabric on start-up to facilitate the ballooning function which may last throughout the entire processing job without the need to add additional liquid and air. If a hole appears in the fabric the rolls and pipes are disposed to fall together to trigger a limit switch, not shown, to stop the apparatus or sound an alarm to cause a technician to take preventive action. More particularly as is shown in FIG. 2 a water cascade flows on the fabric to wet same and is provided by any well known means such as by a spray system 26 formed in pipes 37 - 37' shown in FIG. 2. Air is provided via pipes 36 - 36' which are positioned relative the fabric 14 so air penetrates the fabric interior 30 and causes same to balloon as shown in FIG. 2. The fabric is guided into the first nip 42 wherein it is essentially flattened and the wrinkles are removed to better prepare the fabric for further processing. The fabric 14 is guided into a first nip 42 formed by a first roll 44 and a second roll 46, the nip 42 operates to remove excess moisture from the fabric 14. The rolls also serve to provide a reservoir 50 in cooperation with the sealing members or dams 52 and 54 mounted on the opposite ends 56 and 58 of the rolls 44 and 46. Any well known method for mounting these sealing means may be utilized. For example they may be attached mechanically and spring loaded in any well known fashion. It is beneficial when mounting these dams 52 and 54 to do so by utilizing a design that permits leakage of the additive to the ends 56 and 58 of the rolls to lubricate the rolls and the dams. Thusly the additive in the reservoir 50 serves to cool the ends 56 and 58 and the rolls 44 and 46. The additive 50' is provided to the reservoir 50 through a pipe and pump arrangement, the piping is designated 62 and the additive 50' is moved by pump 64 connected to a source of such additive, not shown, through the piping to a spray or discharge apparatus designated 68. As was mentioned hereinabove the reservoir arrangement provides a simple and efficient means for applying additive to the fabric 14 as desired. Also with the addition of a third roll 70 arranged relative roll 46 to provide second nip 72, easy extraction of excess moisture or additive is achieved.

Figure 3:
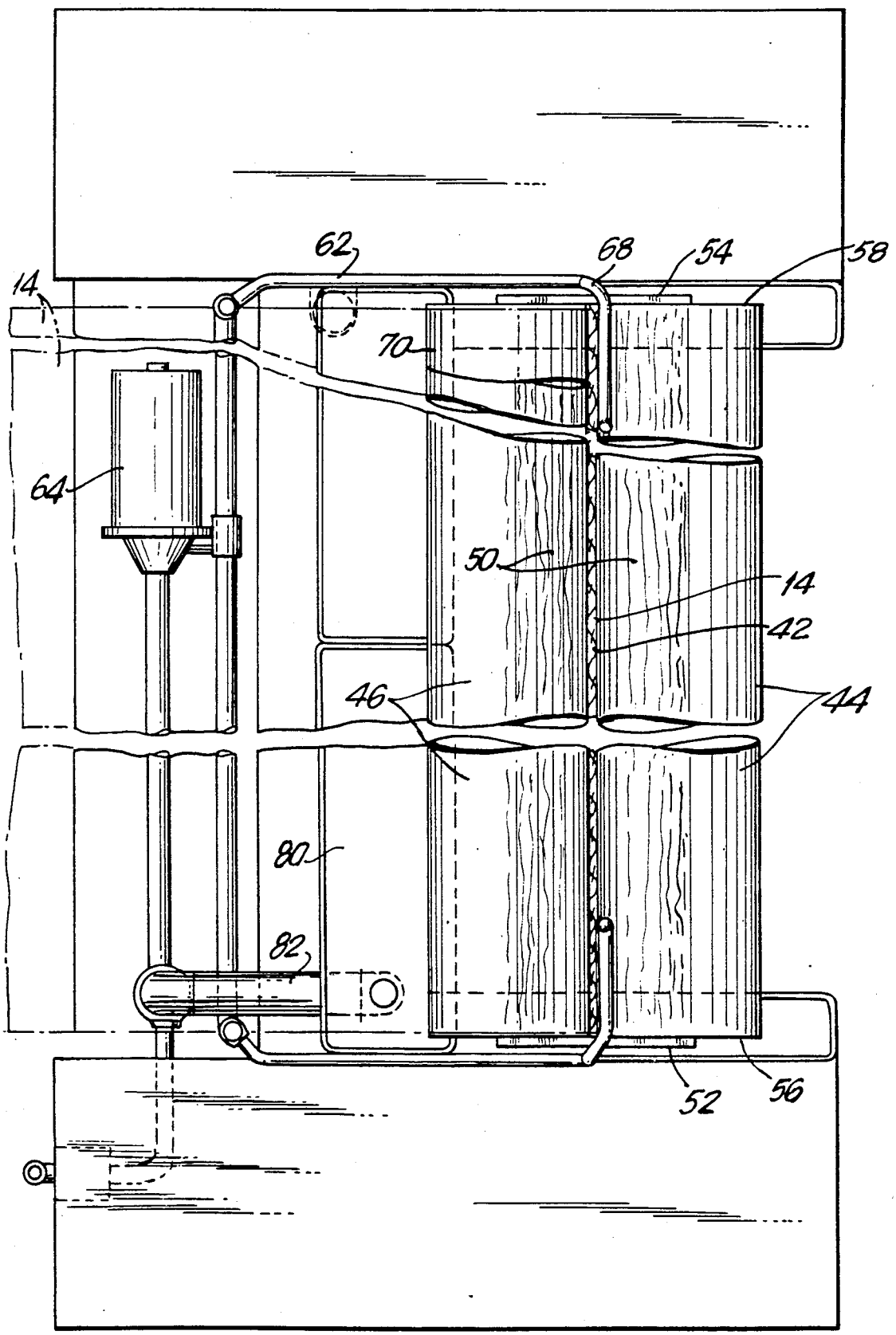
FIG. 3 is a top view of the extraction members, also partly in section showing the invention contemplated herein.
Figure 4:
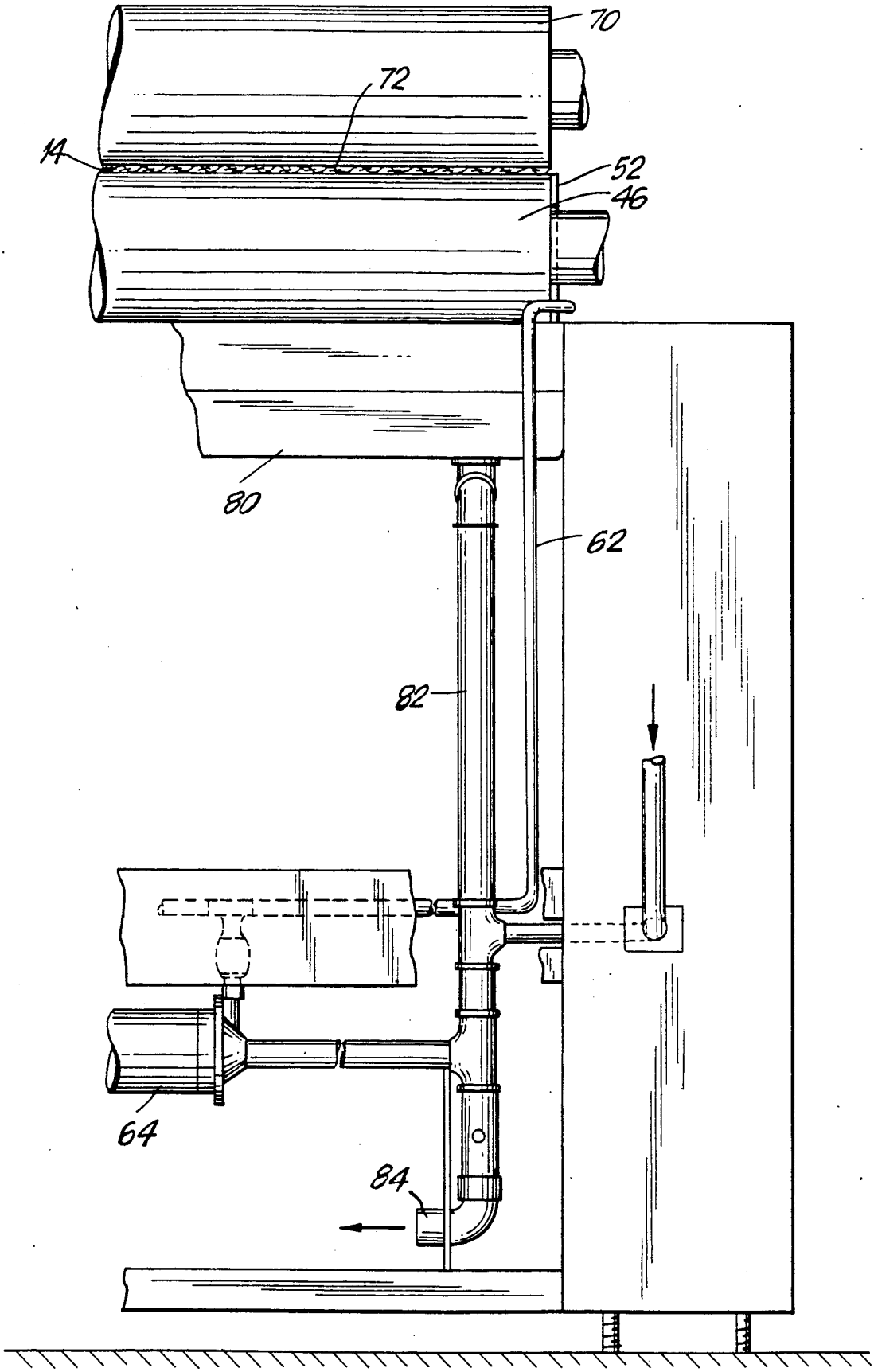
FIG. 4 is a partial front view of the extraction system contemplated by this invention.

A condensate collector 80 comprising a single unit or two units as shown in FIG. 3 is mounted internally in the extraction chamber 12 and is connected to a condensate line 82 having a discharge end 84 to dispose of such condensate as desired. It is desirable to arrange the members 24 and pipes 36 - 36' and rolls 35 - 35' so that the fabric passes from member 24 in a vertical upward direction and also flows into the, nip 42 in a vertical direction. By following this procedure you shorten as much as possible the distances the fabric travels in an unsupported fashion thusly reducing the stresses caused on the fabric which affect its stability.

This last mentioned objective is also achieved by arranging the rolls as shown in the drawings so that the fabric flows into the first nip 42 in an upwardly generally vertical direction and then immediately is passed through the additive in the reservoir 50 and proceeds in a direction which is at right angles to its flow through the the first nip 42 as it is immediately moved through the second nip 72 as is shown in FIG. 2.

It is also noted that in an operation of the system of the type contemplated herein that drier fabric is preferred after extraction of liquid from said fabric as it passes the first nip 42 and such a nip is referred to as a hard nip in the art. Whereas a less dry fabric is preferred after extraction of the additive as it flows through the second nip 72. Such a nip is referred to as the soft nip in the art. Generally the fabric may be driven with the provision of a drive in association with rolls 20 - 21 and with one of the rolls 44 or 46 with the concomitant benefits. Preferably a drive, not shown, would be associated with the roll 46 and function to move the fabric from its entry point to the discharge position as is shown in FIG. 2.

As will be understood by one skilled in the art delivering the fabric in flat form to the extracting nips is most desirable as the various processing steps to follow are performed more efficiently and a better fabric results. Also it is normal to pass the fabric from the nip 72 to a guide roll and then to a spreader, as best shown in FIG. 1, then into a container. It will be clear that the fabric could also be transferred to another processing step also. The important aspect is to keep distances between the various stages as short as possible to retain fabric stability and geometric configuration. It should be understood of course that specific forms of the invention herein illustrated and described are intended to be representative only as certain changes may be made in the invention without departing from the clear teachings of the disclosure. Accordingly, reference should be made to the following appended claims determining the full scope of the invention.

I claim:

1. In a ballooned fabric extraction apparatus comprising:

(a) an extraction chamber for treating tubular knitted fabrics;

(b) said extraction chamber including a fluid and liquid fabric application arrangement in the internal portion of said extraction chamber;

(c) means for the extraction chamber to move the tubular knitted fabric to the internal portion thereof;

(d) first- means for the extraction chamber to guide said tubular knitted fabric in a predetermined direction in said extraction chamber;

(e) said fluid and liquid fabric application arrangement acting on said tubular knitted fabric to cause same to balloon;

(f) first and second roll means on said extraction chamber to form a first nip for receiving said tubular knitted fabric in a desired direction and in ballooned form from said extraction chamber;

(g) said first nip operative to smooth said tubular knitted fabric;

(h) one of said first and second rolls being driven so that said driven roll functions to move said tubular knitted fabric through said first nip wherein excess liquid in said fabric is removed;

(i) a third roll disposed relative one of said first and second rolls to form a second nip;

(j) an additive supply reservoir formed by said first and second rolls to serve as a bath for said tubular knitted fabric when it is desired to apply an additive to same;

(k) a dam means at each of the ends of said rolls to cooperate with the first nip to limit leakage of said additive from said reservoir;

(l) said third roll also being driven by the first or second roll whereby said tubular knitted fabric moves through the reservoir to the second nip so that excess liquid is removed therefrom;

(m) condensate disposal means arranged relative said second nip to receive excess additive therefrom; and (n) an additive supply means connected to said reservoir.

2. The apparatus according to claim 1 wherein the dam means is arranged at the ends of the first and second rolls to permit a preselected degree of leakage of additive to lubricate said first and second rolls.

3. The apparatus according to claim 1 wherein said first nip and the guide portion of said first means are disposed so that said tubular knitted fabric flows in a vertical direction into said first nip.

4. The apparatus according to claim 2 wherein said first nip and said first extraction chamber guide means are disposed so that said tubular knitted fabric flows in a vertical direction into said first nip.

5. The apparatus according to claim 1 wherein said first nip is operative to remove more liquid from said fabric than additive removed from said fabric by the second nip to thereby have a wetter fabric flowing from the second nip than the first nip.

6. The apparatus according to claim 4 wherein said first nip and the guide portion of said second means are disposed so that said tubular knitted fabric flows in a vertical direction into said first nip.

7. The apparatus according to claim 4 wherein the leakage of the additive lubricates the ends of said first and second rolls.

8. The method of applying an additive to a tubular knitted fabric which has been ballooned and expanded uniformly in a balloon extraction chamber wherein the fabric after being so processed is:

(a) flowed in an upwardly vertical direction into a first nip and said tubular knitted fabric being in a uniformly expanded shape;

(b) moving said fabric through said first nip in order to remove excess liquid from said tubular knitted fabric;

(c) collapsing said fabric in said nip to maintain same in expanded condition;

(d) immediately after removal of the liquid from said tubular knitted fabric subjecting same to the application of an additive by passing said fabric through a reservoir formed to include a part of said first nip;

(e) moving said tubular knitted fabric through a second nip in close proximity with said first nip to remove the excess additive from said second nip in a manner whereby fabric elongation is controlled.

(f) removing the fabric from said second nip in a manner whereby fabric elongation is controlled.

9. The method according to claim 8 including the additional step of moving the tubular knitted fabric into the second nip in a direction that is generally at right angles to said fabric as it moves through the first nip.

10. The method according to claim 8 wherein the fabric is subjected to the additional step of being subjected to more liquid removal in the first nip than in the second nip.

* * * * *